US010024496B2

(12) United States Patent
Hauge

(10) Patent No.: US 10,024,496 B2
(45) Date of Patent: Jul. 17, 2018

(54) SPLIT PRESSURE VESSEL FOR TWO FLOW PROCESSING

(71) Applicant: Isobaric Strategies Inc., Virginia Beach, VA (US)

(72) Inventor: Leif J. Hauge, Virginia Beach, VA (US)

(73) Assignee: Leif J. Hauge, Virginia Beach, VA (US)

( * ) Notice: Subject to any disclaimer, the term of this patent is extended or adjusted under 35 U.S.C. 154(b) by 0 days.

(21) Appl. No.: 15/480,111

(22) Filed: Apr. 5, 2017

(65) Prior Publication Data

US 2018/0058631 A1 Mar. 1, 2018

Related U.S. Application Data

(63) Continuation of application No. 13/983,429, filed as application No. PCT/US2012/023980 on Feb. 6, 2012.

(60) Provisional application No. 61/439,515, filed on Feb. 4, 2011.

(51) Int. Cl.

| | |
|---|---|
| ***F04F 13/00*** | (2009.01) |
| ***F17C 1/02*** | (2006.01) |
| ***F28F 9/00*** | (2006.01) |
| *F28D 9/00* | (2006.01) |

(52) U.S. Cl.

CPC ..... *F17C 1/02* (2013.01); *F04F 13/00* (2013.01); *F28F 9/00* (2013.01); *F28D 9/0006* (2013.01)

(58) Field of Classification Search

CPC ..... F04F 13/00; F02B 33/42; B01D 61/06; F15B 3/00; F17C 1/02; F28F 9/00; F28D 9/0006

USPC ..... 417/64

See application file for complete search history.

(56) References Cited

U.S. PATENT DOCUMENTS

| | | | |
|---|---|---|---|
| 2,214,208 | A | 9/1940 | Spreng |
| 2,675,173 | A | 4/1954 | Jendrasski |
| 3,249,153 | A | 5/1966 | Holland et al. |
| 4,086,034 | A | 4/1978 | Hokky |
| 4,269,570 | A | 5/1981 | Rao |
| 4,871,014 | A | 10/1989 | Sulzberger |
| 4,887,942 | A | 12/1989 | Hauge |
| 6,379,127 | B1 | 4/2002 | Andrews |

(Continued)

FOREIGN PATENT DOCUMENTS

| | | |
|---|---|---|
| CN | 1272166 | 11/2000 |
| CN | 200985289 | 12/2007 |

OTHER PUBLICATIONS

International Search Report for PCT/US12/23980 dated May 23, 2012.

(Continued)

*Primary Examiner* — Nathan Zollinger
(74) *Attorney, Agent, or Firm* — Hunton Andrews Kurth LLP

(57) ABSTRACT

A split pressure vessel for processing of two flows encountered with energy exchange devices, consisting of two opposite facing end caps 1,2 having each a side port for low pressure 3,5 and one axial port 4,6 preferably in the same plane as the side ports. Each end cap has internal structurally integrated manifolds for high pressure 17,22 and low pressure manifold 19,24 connecting to axial ports of the internal energy exchange device. The high pressure side of one end cap may be structurally integrated with a circulation pump or booster 26 having a submersible or external motor.

9 Claims, 3 Drawing Sheets

(56) References Cited

U.S. PATENT DOCUMENTS

| | | | |
|---|---|---|---|
| 6,537,935 | B1 | 3/2003 | Seth et al. |
| 7,207,781 | B2 | 4/2007 | Shumway |
| 7,214,315 | B2 | 5/2007 | Shumway |
| 7,306,437 | B2 | 12/2007 | Hauge |
| 7,815,421 | B2 | 10/2010 | Bross et al. |
| 2006/0032808 | A1 | 2/2006 | Hauge |
| 2006/0037895 | A1 | 2/2006 | Shumway |
| 2006/0245909 | A1 | 11/2006 | Stover |
| 2011/0006006 | A1 | 1/2011 | MacHarg |

OTHER PUBLICATIONS

International Preliminary Report on Patentability and Written Opinion of International Searching Authority for PCT/US12/23980 dated Aug. 6, 2013.

SPLIT PRESSURE VESSEL FOR TWO FLOW PROCESSING

CROSS-REFERENCE TO RELATED APPLICATIONS

This patent application is a continuation of U.S. patent application Ser. No. 13/983,429, filed Sep. 10, 2013, which is a national stage application of International Patent Application No. PCT/US2012/023980, filed Feb. 6, 2012, which claims priority to U.S. Provisional Patent Application No. 61/439,515, filed Feb. 4, 2011, the disclosures of each of which are herein incorporated by reference.

FIELD OF THE INVENTION

The invention relates to fluid processing, and specifically for a pressure vessel for energy exchange between two fluids. In particular, the invention relates to a pressure vessel arranged as two opposing end caps forming a pressure vessel for an energy exchange device.

BACKGROUND OF THE INVENTION

Pressure vessels for energy exchange devices such as heat exchangers have been in industrial use for long time. In the last 10-15 years a new energy exchange device termed a pressure exchanger has been commercialized. This device has adapted standard commercial composite pressure vessels used for membrane separation by reverse osmosis.

Such pressure vessels are designed for the insertion of single or multiple membrane modules from both ends without removing the pressure vessel, but this is not a requirement as housing for an energy exchange device. Hence it becomes a bulky solution with multiple seals needed for the inlet and discharge of two different fluid streams. Such seals tend to develop leaks over time and need replacement.

Composite vessels need to be oversized and heavy to account for the gradual fracturing of reinforcement fibers over perhaps a life of 25 years. In order to secure end caps the vessel need to be extended substantially, which account for a large loss of productive volume since only a short net length is required for an energy exchange device.

In addition it is desirable to arrange either the inlet or discharge flow through a side port of the pressure vessel. For a composite vessel this becomes particularly challenging as such a port cannot have a very large diameter without substantial increased wall thickness, added weight and cost.

U.S. Pat. No. 7,306,437 discloses a pressure exchanger having a metal pressure vessel with thin walls that accommodate cast or welded in 2 side ports. The pressure vessel is made of a section containing three of the four ports, while the end cap provides the fourth port.

Although this design eliminates many of the concerns with using composite pressure vessels, it has some important limitations. The design does not allow for radial flow through side ports of low pressure fluid, which is desirable in order to integrate a circulation pump for the high pressure stream. Direct low pressure flow through a side ported ceramic end cover poses difficult sealing issues and/or an destructive asymmetric side load of the end cover.

Furthermore, the long vessel imposes manufacturing issues in terms of internal machining and size when casting.

SUMMARY OF THE INVENTION

Thus, there is a need for a pressure vessel that does not have the above noted disadvantages of existing pressure vessels for energy exchange. Thus, at least one objective of the invention is to provide a pressure vessel that is not encumbered by the aforementioned disadvantages In accordance with at least one embodiment of this invention, a pressure vessel for an energy exchange device suitable for integration with a circulation pump for the high pressure flow is provided. The pressure vessel according to this embodiment diverts the low pressure flows into side ports and provides in-line straight axial high pressure flow conduits where one end cap is mechanically integrated to a circulation pump.

In accordance with at least one embodiment of this invention, a pressure vessel for an energy exchange device with improved manufacturing efficiency is provided. The pressure vessel according to this embodiment consists of two opposite facing end caps connected mechanically with a seal, each having one inlet and one outlet for one stream.

In accordance with at least one embodiment of this invention, a pressure vessel for an energy exchange device that will not develop external leaks through seals are provided. The pressure vessel according to this embodiment has preferably cast or welded end caps with structurally integrated ports.

These and other embodiments and advantages of the present invention, which may be employed individually or in selective combination, will become apparent from the following detailed description, taken in conjunction with the accompanying drawings, illustrating by way of example the principles of the invention.

DESCRIPTION OF PREFERRED EMBODIMENTS

The following description is intended to convey a thorough understanding of the embodiments described by providing a number of specific embodiments and details involving an improved pressure vessel for energy exchange from one fluid stream to another. It should be appreciated, however, that the present invention is not limited to these specific embodiments and details, which are exemplary only. It is further understood that one possessing ordinary skill in the art, in light of known systems and methods, would appreciate the use of the invention for its intended purposes and benefits in any number of alternative embodiments, depending upon specific design and other needs.

Figure 1:
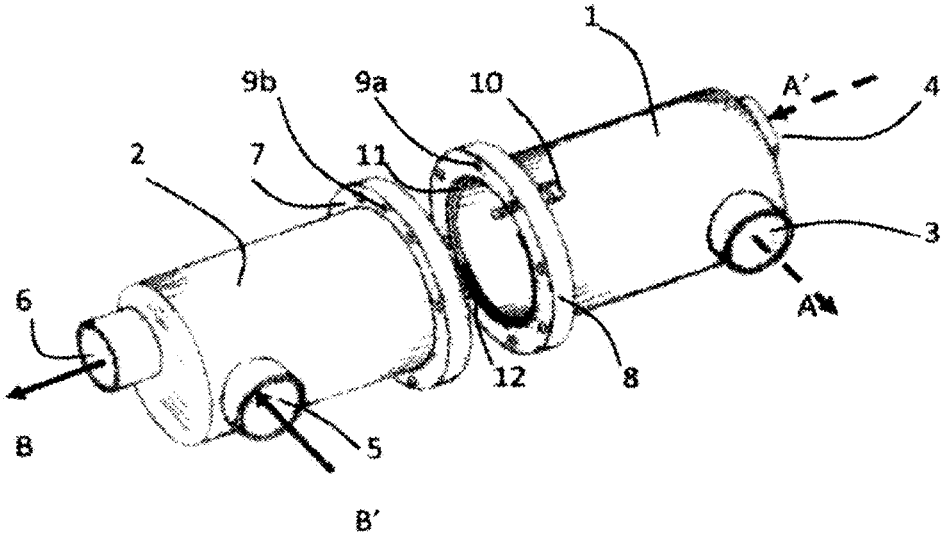
FIG. 1 is an external exploded perspective view of a split pressure vessel for processing of two streams according to at least one embodiment of the invention.

Referring now to FIG. 1, an external embodiment of a split pressure vessel according to at least one embodiment of the invention is illustrated. The pressure vessel depicted in FIG. comprises two preferably elongated end caps 1 and 2 for separate fluid streams, where the first has a side port for low pressure outflow 3 of the first stream A and an axial port for high pressure inlet 4 of the first stream A' substantially parallel to the mutual center axis of both end caps and preferably in the same plane as the side port.

The second end cap has a side port for low pressure inflow 5 of the second stream B' preferably in the same plane as the side port of the first end cap. The second stream B has an axial port for high pressure outlet 6 substantially parallel to the center axis of both end caps.

Each end cap has a flange 7 and 8 with holes 9 for bolts 10 connecting the two end caps to form a pressure vessel. One of the flanges has shoulder or groove 11 for an a-ring 12 to form a face seal between the end caps. Although not depicted on the drawing, any known method of mechanically fixing the end caps together, such as but not limited to a grooved fitting is considered a part of the invention. Furthermore it is noted that all ports are either cast in or welded to the end caps without any kind of additional seal.

Figure 2:
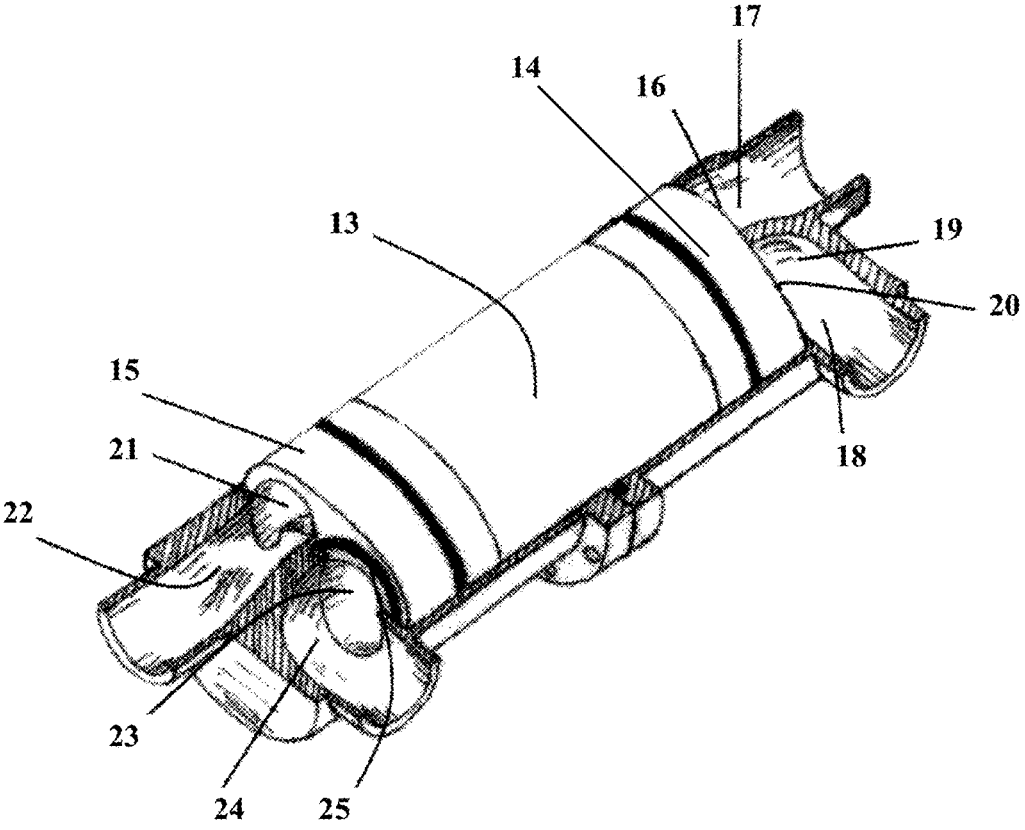
FIG. 2 is a partial and full cut-away perspective views of the pressure vessel with a pressure exchanger according to the exemplary embodiment illustrated in FIG. 1.

FIG. 2 shows the particular embodiment of the split pressure vessel with an internal pressure exchanger assembly which includes a rotatable central rotor 13 having a non-rotating, static end cover 14 for the first stream and another non-rotating, static end cover 15 for the second stream. The end cover for the first stream has one axial high pressure inlet port 16 directly connecting to the structurally integrated high pressure manifold 17 of the first end cap, and an axial low pressure discharge port 18 connects directly to the structurally integrated out flow manifold 19 of the first end cap, which has a static seal 20 which sealingly isolates the low pressure discharge port 18 from the high pressure inlet port 16.

The end cover for the second stream has one axial high pressure outlet port 21 directly connecting to the structurally integrated high pressure manifold 22 of the second end cap, and an axial low pressure inlet port 23 connects directly to the structurally integrated inlet manifold 24 of the first end cap, which has a static seal 25 which sealingly isolates the low pressure inlet port 23 from the high pressure outlet port 21.

Figure 3:
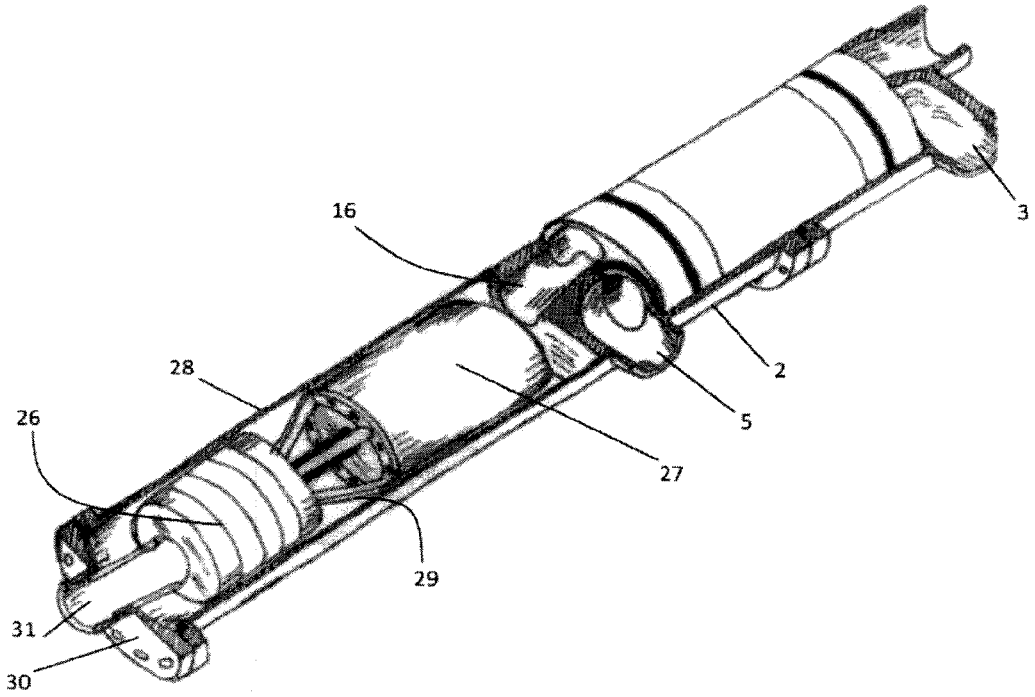
FIG. 3 is a cut-away perspective view of a circulation pump driven by a submersible motor integrated with one end cap.

FIG. 3 shows the second end cap 2 having an integrated circulation pump 26 driven by a submersible motor 27 attached to the pump with a mounting frame 29. The high pressure outlet manifold 22 discharges flow into submersible motor end of the pump housing 28. The pump 26 is attached at the discharge port cover 30. The pump hosing 28 is cast or weld integrated with the second end cap 2 and may have a flange for attaching the discharge port cover, which has an axial discharge port 31 preferably in the same plane as the axial inlet port 16 and the side ports 3 and 5.

The circulation pump or booster may be any kind of suitable pump, including but not limited to a multistage centrifugal pump. It would be particular useful with the pressure exchanger if the pump could be reversible. Pressure exchangers are mostly used with reverse osmosis plants, which accept different feed waters including but not limited to sea water that have considerable fouling potential. If flow could be reversed periodically through the membranes, cleaning may be omitted or substantially reduced or expensive pretreatment avoided. If so, a less expensive surface water intake may be used rather than costly drilled wells.

Figure 4:
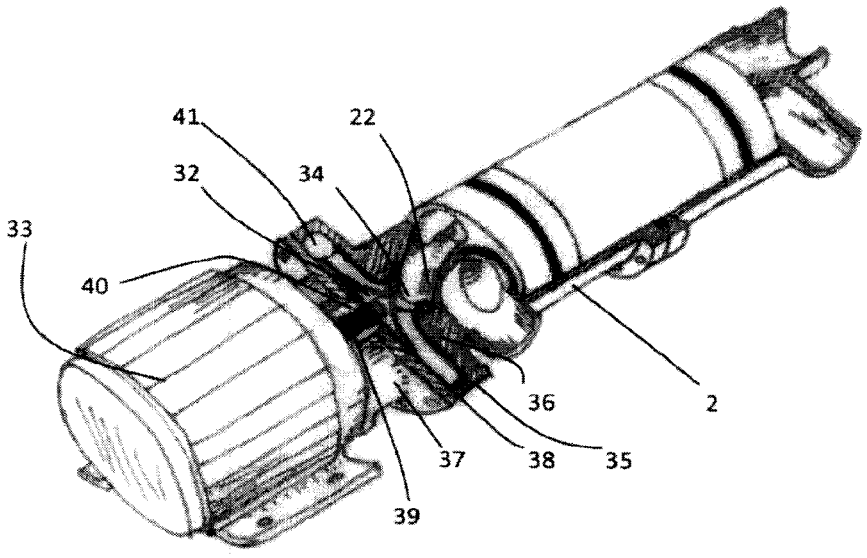
FIG. 4 is a cut-away perspective view of a circulation pump integrated with one end cap and driven by an external motor.

FIG. 4 shows the second end cap 2 having an integrated circulation pump 32 driven by an external motor 33. The high pressure outlet manifold 22 discharges flow into the inlet 34 of the pump housing 35. The inlet side of the pump housing 36 is a structurally integrated part of end cap 2 by casting or welding. The discharge side 37 is connected to the inlet side 36 through bolted flanges or similar methods and a seal 38. The pump shaft 39 is equipped with a high pressure rotary face seal 40. The high pressure flow from the pump is discharged through the pump outlet 41.

U.S. Pat. No. 7,306,437 is hereby incorporated by reference in its entirety.

What is claimed is:

1. An apparatus comprising:

a split pressure vessel having two, opposite facing first and second cylindrical end caps configured for separate fluid streams, the end caps in direct contact and aligned along the same central axis through a single mechanical coupling configured to absorb axial separation force from the pressure within the first and second end caps, each end cap having at least one high pressure port in flow communication with a high pressure manifold, and at least one low pressure port in flow communication with a low pressure manifold; and a separate internal pressure exchange assembly inside the split pressure vessel comprising a rotor arranged for rotational movement between static first and second end covers, each cover having a rotor side and a manifold side; and having a static seal situated upon the manifold side of each end cover such that the low pressure manifold of each end cap is sealingly isolated from its adjacent high pressure manifold.

2. The apparatus of claim 1, wherein the first and second end caps are separable.

3. The apparatus of claim 1, wherein the split pressure vessel provides in-line straight axial high pressure flow conduits.

4. The apparatus of claim 1, wherein each end cap has an axial port situated on the end wall of the respective end cap parallel to the central axis and in flow communication with a high pressure manifold, and a radial port situated on a side wall of the respective cap perpendicular to the central axis and in flow communication with a flow pressure manifold, the low pressure manifold situated adjacent to the high pressure manifold.

5. The apparatus of claim 1, further comprising a mechanically integrated circulation pump.

6. The apparatus of claim 5, wherein the first end cap or the second end cap is permanently mechanically integrated to the circulation pump.

7. The apparatus of claim 5, wherein the circulation pump is a submersible pump with a motor.

8. The apparatus of claim 5, wherein the circulation pump has an external motor with a shaft seal.

9. The apparatus of claim 5, wherein the circulation pump is capable of reversing flow direction.

* * * * *